United States Patent [19]

Schneider

[11] 4,086,179

[45] Apr. 25, 1978

[54] IMPROVED CLEANING SOLVENT CONTAINING NON-AZEOTROPIC MIXTURES OF 1,1,1-TRICHLOROETHANE AND N-PROPANOL

[75] Inventor: Alvin F. Schneider, Edison, N.J.

[73] Assignee: Alpha Metals, Inc., Jersey City, N.J.

[21] Appl. No.: 749,274

[22] Filed: Dec. 10, 1976

[51] Int. Cl.[2] ..... C23G 5/02; C11D 7/50; C11D 7/30

[52] U.S. Cl. ..... 252/171; 134/31; 134/38; 134/40

[58] Field of Search ..... 252/171, DIG. 9, 364; 134/31, 40, 38

[56] References Cited

U.S. PATENT DOCUMENTS

| | | | |
|---|---|---|---|
| 2,371,644 | 3/1945 | Petering et al. | 252/171 X |
| 3,192,273 | 6/1965 | Bissinger | 252/171 X |
| 3,637,513 | 1/1972 | Schneider | 252/171 |
| 3,767,585 | 10/1973 | Sawabe et al. | 252/171 |
| 3,932,297 | 1/1976 | Clementson et al. | 252/171 |

*Primary Examiner*—Harris A. Pitlick
*Attorney, Agent, or Firm*—Lerner, David, Littenberg & Samuel

[57] ABSTRACT

Improved cleaning compositions for the removal of various forms of contamination from printed circuit boards and other related electronic equipment in vapor cleaning processes are disclosed, including major amounts of 1,1,1-trichloroethane and an amount of normal propanol less than that in the true azeotropic mixture of these components, generally from about 1.0 to less than 4.75 weight percent of the normal propanol. In addition, vapor cleaning processes utilizing such solvent compositions are also disclosed, and in a preferred embodiment, the composition includes about 96.0 weight percent of the 1,1,1-trichloroethane and about 4.0 weight percent of the normal propanol.

2 Claims, No Drawings

IMPROVED CLEANING SOLVENT CONTAINING NON-AZEOTROPIC MIXTURES OF 1,1,1-TRICHLOROETHANE AND N-PROPANOL

FIELD OF THE INVENTION

The present invention relates to cleaning compositions for the removal of residue from printed circuit boards and other related electronic equipment. More specifically, the present invention relates to such cleaning compositions for use in vapor cleaning or vapor degreasing processes to accomplish such results. Still more particularly, the present invention relates to combinations of 1,1,1-trichloroethane and normal propanol for use in such vapor cleaning processes.

BACKGROUND OF THE INVENTION

During the production of printed wiring assemblies or printed circuit boards on which electronic components, such as transistors, capacitors, etc. are mounted, many contaminants are present thereon. For example, the side of the printed circuit board which is to be soldered is generally contaminated by solder fluxes and other resinous materials, and in addition, considerable residue can also lodge on the top or mounting surface of these circuit boards. Rosin flux residues left on printed circuit boards and other electronic assemblies after soldering contain activators and their decomposition products (amine hydrochlorides [$RNH_3^+Cl^-$] being typical). These residues, which are ionic in nature, can lead to electrical leakage and cause corrosion if not completely removed after the soldering operation. While the rosin itself is non-ionic and non-corrosive, it too should be completely removed after soldering since it encapsulates ionic residues from flux activators. Unremoved flux residues can also lead to sticking and malfunctioning of component switches and can cause mealing and adhesion problems with conformal coatings. Complete removal of flux residues is, therefore, a key factor in guaranteeing long-term reliability of electronic circuits and components. Many methods have been described in the past for cleaning these printed circuit boards. These have included the scrubbing of the boards themselves, both on the bottom and top surface thereof, and the use of various solvent compositions in a liquid bath, including the use of stirring, ultrasonic waves, etc.

One method for cleaning printed circuit boards is disclosed in German Pat. No. 2,403,428, owned by Imperial Chemical Industries, Ltd. That patent teaches the use of certain specific solvent compositions in the cleaning of printed circuit boards in a bath or liquid system. That patent is thus concerned with a technique commonly referred to as "kiss cleaning", in which the cleaning liquid comes into contact only with the bottom side of the printed circuit board. In particular, the patentee teaches azeotropic compositions of 1,1,1-trichloroethane and aliphatic alcohols containing at least 2 carbon atoms. He also teaches such combinations of 1,1,1-trichloroethane and aliphatic alcohols containing at least 3 carbon atoms in order to raise the flash point of the mixture as the number of carbon atoms are increased. He therefore prefers to use alcohols such as butanol, pentanol, etc. The patentee does disclose the use of normal propanol in his application as well as the use of certain stabilizers in connection with the 1,1,1-trichloroethane composition. He does not, however, concern himself with suitable compositions for vapor cleaning processes, nor with mixtures that have the complete absense of a flash point.

In addition, an alternative process for cleaning printed circuit boards is disclosed in German Pat. No. 2,321,880 to Voldeholms A.B. This patentee discloses the use of a cleaning solution which contains an alcohol containing from 4 to 6 carbon atoms and a chlorinated carbon soluble solution such as 1,1,1-trichloroethane, perchloroethylene and trichlorethylene. These compositions are again disclosed as useful in various liquid cleaning systems, with the cleaner being used at temperatures between 20° and 50° C. with the aid of a brush. The patentee also notes that his invention is advantageous because the flash point of many of these compositions is not reached until the boiling point of the azeotrope is reached. Again he does not concern himself with suitable compositions for vapor cleaning processes, nor with mixtures that have the complete absence of a flash point, even at their boiling point.

Vapor cleaning or vapor degreasing processes utilize the cleaning mechanism whereby the vapor of boiling solvent is condensed directly on the assembly being cleaned, thereby dissolving and carrying away the soil. Such vapor cleaning processes are generally considered more desirable than cleaning solution, liquid bath or cold cleaning processes since in vapor cleaning processes evaporation losses are more readily controlled, the workpiece emerges from the process in an already dry condition, and the cleaning can be only in pure vapor and cleaner distillate, thereby avoiding contamination from workpieces already cleaned in the process. Vapor cleaning can be accomplished in batch type degreasers whereby soldered assemblies are accumulated in metal baskets and placed in the degreaser, or with in-line degreasers whereby soldered assemblies are conveyed through the degreaser. Besides cleaning in the solvent vapor, degreasers can be designed to allow cleaning by immersion in the boiling liquid, in the warm liquid distillate, or spraying with liquid distillate. Usually a combination sequence such as vapor-spray-distillate-vapor is employed.

In the past there have also been attempts to utilize various solvent compositions, particularly various azeotropic compositions, in such vapor degreasing procedures for cleaning printed circuit boards. Thus, in patents such as U.S. Pat. No. 3,671,442 and 3,671,446, and others, various such azeotropic compositions are disclosed. These compositions have the disadvantage of consisting largely of an expensive fluorinated solvent, thereby limiting their widespread use in electronic cleaning applications. Furthermore, some ot these compositions have a flash point or contain a C-4 or higher alcohol which is not particularly effective as an additive for removing ionic flux activators.

An ideal solvent for use in vapor degreasing processes and the like would, of course, not have a flash point, even at its boiling temperature. Secondly, the mixture should contain a sufficiently polar solvent in a concentration sufficient to enable the removal of ionic flux residues such as activators, as well as a non-polar solvent to remove non-polar soils like rosin and soldering oils. Additionally, it would also be most desirable to employ an azeotropic mixture or near azeotropic mixture so that the composition of the mixture remains relatively constant under normal operating conditions, and so that it may be recovered for reuse. Lastly, the mixture should not contain any expensive components that would limit it from being used in widespread printed circuit board and other related electronic equipment cleaning, including the cost sensitive home products electronics industry.

SUMMARY OF THE INVENTION

In accordance with the present invention, it has now been unexpectedly discovered that a particular cleaning composition useful in vapor cleaning processes for the cleaning for various electronic equipment, such as printed circuit boards, and which has these required properties, can be prepared from 1,1,1-trichloroethane. The applicant has unexpectedly found that while it has been known to employ 1,1,1-trichloroethane (or methyl chloroform) in azeotropic compositions for the cleaning of printed circuit boards in a liquid state, that the use of such a compound in combination with normal propanol where that alcohol is present in an amount less than that of the azeotropic composition results in a highly unexpected improvement wherein the composition has no flash point, and a narrow boiling range with a relatively constant composition in vapor degreasing processes. Such near azeotrope properties make the mixture highly desirable for vapor degreasing processes. This composition is extremely useful in such processes, since its lack of a flash point sharply increases the safety factor in connection therewith.

In one embodiment of the present invention, the cleaning composition includes a major amount of 1,1,1-trichloroethane and from about 1.0 to less than 4.75 weight percent of the alcohol, preferably from about 1.0 to less than about 4.5 weight percent of the alcohol. It has thus been found that such compositions containing 4.75% or more of the normal propanol (including the azeotrope composition with 7.0% alcohol) are undesirable, since they have a flash point when measured in accordance with the Tag Open Cup method, ASTM D1310. On the other hand, such compositions containing less than about 1.0% normal propanol are undesirable since the alcohol content is too low to be of practical benefit for dissolving ionic flux residues. Compositions from about 1.0 to less than 4.75% normal propanol have the desired balance of non-flammability as measured by flash point and sufficient polar solvent content to aid in the removal of ionic flux residues.

In a preferred embodiment of the present invention, the cleaning composition includes 96% 1,1,1-trichloroethane and 4% normal propanol. This composition provides the highest alcohol content for maximum removal of ionic flux residues while staying sufficiently below the 4.75% alcohol flammable level, to allow for slight composition variance in solvent blending.

In another embodiment of the present invention, printed electronic circuit boards are cleaned in a vapor cleaning process in which a cleaning composition is employed as described above, including a major amount of 1,1,1-trichloroethane and an amount of normal propanol, as discussed above.

DETAILED DESCRIPTION 1,1,1-trichloroethane or methyl chloroform is known as an excellent solvent for the cleaning of precision electronic equipment of various kinds, for metal degreasing, and other such purposes. It is a non-polar solvent, which makes it effective for removing non-polar, non-ionic soils from printed circuit boards, such as rosin and soldering oils. However, it has very little ability to dissolve polar, ionic soils such as flux activators. 1,1,1-trichloroethane has no flash point, and has a boiling point of 165° F., which is ideal for vapor cleaning. It is readily available and not particularly expensive.

Normal propanol or normal propyl alcohol, which is used in the compositions of the present invention along with the 1,1,1-trichloroethane, has excellent polar solvency making it very effective for removing polar, ionic residues, such as flux activators, from the printed circuit boards. Normal propanol has a boiling point of 207° F., and a Tag Open Cup flash point of 81° F., making it highly flammable and dangerous to employ along in the process of the present invention. It is readily available and again is not particularly expensive.

The other $C_1$ to $C_3$ alcohols, namely, methanol, ethanol and isopropanol, like normal propanol, have excellent polar solvency. All of the $C_1$ to $C_3$ alcohols, however, have flash points. In addition, all of them form azeotropes with 1,1,1-trichloroethane, which likewise, have flash points, making them unsuitable for the vapor cleaning processes of the present invention. The azeotropes of methanol, ethanol, and isopropanol with 1,1,1-trichloroethane contain approximately 20% of the alcohol, which gives them Tag Open Cup flash points of less than 100° F. Even the azeotrope or normal propanol and 1,1,1-trichloroethane, which contains only 7% of the alcohol, has a Tag Open Cup flash point of 146° F., which while much higher than the other alcohol azeotropes already described, is still unsuitable for vapor degreasing according to the present invention since the 146° F. flash point is below its 160° F boiling point and use temperature in vapor cleaning.

C-4 and higher molecular weight alcohols, such as the various isomers of butanol and pentanol, are not sufficiently effective as additives for 1,1,1-trichloroethane for removing ionic residues according to the process of the present invention. They are also more toxic and have disagreeable odors compared to the $C_1$ to $C_3$ alcohols.

It was found that Trichlorotrifluoroethane (or Fluorocarbon 113) can be added to mixtures of $C_1$ to $C_3$ alcohols and 1,1,1-trichloroethane creating ternary solvent blends which do not initially have Tap Open Cup flash points. However, these mixtures are far from true azeotropic compositions. They rapidly change in boiling temperature and increase in alcohol content in vapor cleaning, and eventually may reach a flash point composition. Therefore, these ternary mixtures are also not suitable for the vapor processes of the present invention.

It was also found that none of the mixtures of 1,1,1-trichloroethane with either methanol, ethanol, or isopropanol could be reduced to a lower than azeotropic alcohol content so as not to have a flash point and still give the mixture sufficient polar solvency. It was unexpectedly found, however, that a normal propanol and 1,1,1-trichloroethane mixture could be reduced in alcohol content to certain levels below that in the azeotrope composition of 7% alcohol to produce a mixture that does not have a Tag Open Cup flash point but has a sufficient polar solvent content to remove ionic residues. Specifically, it was found that the normal propanol content of the mixture must be kept under 4.75% by weight in order not to impart a flash point to the mixture. The following are the most significant flash point results obtained with various composition mixtures of normal propanol and 1,1,1-trichloroethane:

| Normal Propanol Concentration | Tag Open Cup Flash Point |
|---|---|
| 7.0% | 146° F |
| 6.0% | 155° F |
| 5.0% | 160° F |
| 4.75% | 165° F |
| 4.5% | None |
| 4.0% | None |

The invention can be further understood by referring to the following example thereof:

Mixtures of normal propanol and 1,1,1-trichloroethane containing at least one percent of the alcohol have some polar solvency for ionic soils. The preferred embodiment of this invention, however, wherein the normal propanol content is 4.0% was used as an example to test the effectiveness of the present composition for ionic flux residue removal. The testing was done with the aid of an instrument commercially known as the Ionograph, sold by Alpha Metals of Jersey City, New Jersey. This instrument can measure the residual ionic contamination on printed circuit board surfaces following a given cleaning procedure. The results are expressed as micrograms of sodium chloride per square centimeter of board area. The lower the value obtained, the more effective the cleaning procedure for removing ionic flux residues. Following a procedure whereby activated rosin flux (known as Alpha 711-35 rosin flux, also sold by Alpha Metals of Jersey City, New Jersey) was applied to G10 epoxy fiberglass boards which were then wave soldered and vapor process cleaned, when the cleaning solvent was pure 1,1,1-trichloroethane, the residual ionic contamination reading was 4.0, whereas when the cleaning solvent was a mixture of 96% 1,1,1-trichloroethane and 4% normal propanol, the reading obtained was only 1.8.

A mixture of 4% normal propanol and 96% 1,1,1-trichlorethane (stabilized) was found to have a narrow boiling range of about 160° to 174° F. Its vapor temperature in a vapor degreaser was found to remain constant at 165° F without changing by more than a couple of degrees, and with negligible composition changes. Thus, while not meeting the strictest technical definition of an azeotrope, from a practical or commercial viewpoint, the mixture does have functional or near azeotrope properties. In the present invention, the compositions of 1,1,1-trichloroethane and normal propanol useful therein will have a relatively narrow boiling range of less than about 20° F, preferably less than about 15° F.

It is conventional to add to these cleaning agents certain well-known stabilizers such as dioxane, anti-oxidants, acid acceptors, wetting agents and water. It is also possible to add limited quantities of other solvents including chlorinated solvents such as trichloroethylene and alcohols such as ethanol without appreciably affecting the basic nature of the invention. However, the addition of any appreciable quantities of these solvents could seriously effect the required properties of the compositions of this invention.

Although the invention has been described by reference to some preferred embodiments, it is not intended that the broad scope of the novel compositions be limited thereby, but that certain modifications are intended to be included within the spirit and scope of the following claims.

What is claimed is:

1. A cleaning composition for removing polar and non-polar contaminants from electronic equipment in vapor cleaning processes consisting essentially of a major amount of stabilized 1,1,1-trichloroethane and normal propanol, said normal propanol being present in an amount of about 4.0 weight percent such that such composition does not exhibit a flash point, and has a relatively narrow boiling range, said amount being less than the amount of said normal propanol in the azeotropic composition of said normal propanol with said 1,1,1-trichloroethane and such that said composition can be safely employed in said vapor cleaning processes.

2. A process for removing both polar and non-polar contaminants from electronic equipment which comprises contacting said electronic equipment with a solvent consisting essentially of a major amount of stabilized 1,1,1-trichloroethane and normal propanol, said normal propanol being present in an amount of about 4.0 weight percent such that said composition does not exhibit a flash point and has a relatively narrow boiling range, said amount being less than the amount of said normal propanol in the azeotropic composition of said normal propanol and said 1,1,1-trichloroethane, said contacting being carried out with said solvent at its boiling point so that said solvent is present in the vapor phase.

* * * * *